US008491280B2

(12) United States Patent
Kameya et al.

(10) Patent No.: US 8,491,280 B2
(45) Date of Patent: Jul. 23, 2013

(54) OIL-FLOODED SCREW COMPRESSOR, MOTOR DRIVE SYSTEM, AND MOTOR CONTROL DEVICE

(75) Inventors: Hirotaka Kameya, Tsuchiura (JP); Masaru Yamasaki, Kasumigaura (JP); Toshiyuki Ajima, Tokai (JP); Masaharu Senoo, Narashino (JP); Hideharu Tanaka, Shizuoka (JP); Norinaga Suzuki, Katori (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 850 days.

(21) Appl. No.: 12/533,097

(22) Filed: Jul. 31, 2009

(65) Prior Publication Data

US 2010/0028165 A1 Feb. 4, 2010

(30) Foreign Application Priority Data

Jul. 31, 2008 (JP) ..... 2008-197175

(51) Int. Cl.
*F04C 18/16* (2006.01)

(52) U.S. Cl.
USPC ..... 417/410.4; 417/32; 417/228

(58) Field of Classification Search
USPC ..... 417/32, 410.4
See application file for complete search history.

(56) References Cited

U.S. PATENT DOCUMENTS

| | | | | |
|---|---|---|---|---|
| 4,724,680 | A | 2/1988 | Kawai | |
| 5,253,481 | A * | 10/1993 | Takagi et al. | 62/126 |
| 5,697,763 | A * | 12/1997 | Kitchener | 417/28 |
| 6,945,073 | B2 | 9/2005 | Matsumoto et al. | |

FOREIGN PATENT DOCUMENTS

| | | |
|---|---|---|
| CN | 1165249 A | 11/1997 |
| JP | 61-132785 | 6/1986 |
| JP | 62-129656 | 6/1987 |
| JP | 63-109297 | 5/1988 |
| JP | 63-109297 A | 5/1988 |
| JP | 9-504069 | 4/1997 |
| JP | 09-303279 | 11/1997 |
| JP | 2952839 | 7/1999 |
| JP | 2003-003976 | 1/2003 |
| JP | 2004-108165 | 4/2004 |
| JP | 2005-214216 | 8/2005 |
| JP | 2008-170017 | 7/2008 |

OTHER PUBLICATIONS

JP Office Action 2008-197175 dated Sep. 7, 2010.
People's Republic of China office action dated Apr. 6, 2001 in English.
Japanese office action dated Feb. 22, 2011.

* cited by examiner

*Primary Examiner* — Charles Freay
*Assistant Examiner* — Philip Stimpert
(74) *Attorney, Agent, or Firm* — Antonelli, Terry, Stout & Kraus, LLP.

(57) ABSTRACT

An oil-flooded screw compressor drives a pair of rotors at a rotational speed which is low enough not to increase torque for a short amount of time after start-up and accelerates the pair of rotors up to a normal-operation rotational speed after oil discharge. Alternatively, the oil-flooded screw compressor rotates the pair of rotors for a short amount of time after the remaining compressed gas is discharged after a halt, thereby allowing the oil accumulated inside the working chambers to be discharged and ensuring smooth start-up after the halt.

6 Claims, 4 Drawing Sheets

OIL-FLOODED SCREW COMPRESSOR, MOTOR DRIVE SYSTEM, AND MOTOR CONTROL DEVICE

BACKGROUND OF THE INVENTION

1. Field of the Invention

The present invention relates generally to oil-flooded screw compressors and also to technologies for avoiding increase in loads on electric motors and power supply circuitry used to drive the compressors.

2. Description of the Related Art

An oil-flooded screw compressor includes therein multiple enclosed spaces, called working chambers or compression cavities, which are formed by meshing the groove of two counter rotors and reducing the spaces between the rotors and the casing that houses the rotors.

While the two meshed counter rotors rotate, each working chamber moves inside the casing, alternating expansion and shrinkage in its volume. Depending on a position of rotors inside the casing, each working chamber communicates with the outside via an opening of the casing or is in an enclosed state. During volume expansion, a working chamber continues to communicate with an opening called a suction port, allowing gas to be drawn in the working chamber from the outside for compression. After the working chamber reaches the position at which its volume is the maximum, the working chamber ends the communication with the suction port, thereby trapping the gas in the working chamber. The gas is then compressed as the working chamber reduces in volume. After the gas is compressed to a given pressure, the working chamber communicates with an opening called a delivery port and discharges the compressed gas therefrom until its volume becomes zero.

SUMMARY OF THE INVENTION

An oil-flooded screw compressor compresses gas while injecting oil into a working chamber that is in a compression stage. The reasons for the oil injection are to lubricate and cool the rotors of the compressor and to prevent leakage of compressed gas from a high-pressure working chamber to a low-pressure working chamber by filling with the oil the interspaces between the rotors and the internal spaces between the rotors and the casing that houses the rotors.

During operation, the temperature of the oil is from 50 to 70 degrees Celsius, and the viscosity of the oil (strictly speaking, the viscosity is the kinetic viscosity of the oil; the same applies below) is low (e.g., less than 40 $mm/s^2$) in the case of an air compressor. Thus, the oil that surrounds the rotors of the compressor does not affect their rotation.

A common mechanism for oil injection into working chambers is a differential-pressure oil injection mechanism that utilizes the pressure difference generated by a compressor between its intake side and discharge side. This oil injection mechanism includes a high-pressure oil reservoir for impounding the oil which has been separated from the compressed gas discharged from the working chambers and also includes a pipe connected to the oil reservoir and to one of the working chambers which has an intake pressure and is in an early compression stage. The oil injection mechanism utilizes the differential pressure between both ends of the pipe to feed oil. In the oil injection mechanism, the oil continues to be fed to the compressor even after the halt of the rotors of the compressor due to the differential pressure that lingers for about 10 to 20 seconds. Thus, much oil accumulates inside the working chambers, and the compressor comes to a halt in such a state.

A compressor has a high temperature of 80 to 100 degrees Celsius around its discharge pathway during operation due to compression heat; however, the temperature of the whole part of the compressor decreases to as low as the ambient temperature if the compressor stays halted for a long time. During a winter season in a cold region, the temperature of the compressor would drop to a temperature below the freezing point, and the viscosity of the oil that stays inside its working chambers would increase up to 150 $mm/s^2$ or higher due to the low temperature.

Thus, an attempt to start up the compressor in such a cold environment may result in an increase in required torque for start-up because the high-viscosity oil interferes with the rotation of the rotors. Especially in a screw compressor, when one of its working chamber moves to the position of the delivery end, the reactive force of oil resulting from collision of the oil against the delivery end acts on the flank of the rotors. At this time, a large inertia force will result in the form of torque.

Even in a cold environment, a variable-speed drive model with a large-capacity electric motor can be started up by the electric motor generating a large torque required for start-up if its power device such as an inverter and the like is reinforced in power. However, if an electric motor and an power device whose capacities are several times as large as that required for operation are mounted on a compressor for the sole purpose of start-up in a cold environment, this is not only a waste of power but makes the use of power during operation far more inefficient compared with that of an electric motor with proper capacity.

Some conventional electric motors such as induction motors can accept excessive start-up torque for only a very short amount of time and are capable of starting up compressors in a cold environment. However, the compressors consume a large current instantaneously during start-up.

Most of the now widely used electric motors are driven by controlling electric current, with the use of semiconductor elements such as inverters and the like. Such electric motors cannot accept large start-up torque due to the possibility of excessive current, even if instantaneous, damaging the semiconductor elements and are not suitable for the start-up that involves large torque.

Drive force transmission systems of compressors vary in type. One is constructed by connecting the output shaft of an electric motor and the rotary shaft of a rotor as one shaft. Another is such that drive force is transmitted from an electric motor to a rotor through shaft joints, gears, or belts. When an electric motor and a rotor are joined together via a flexible shaft joint or a belt, the shaft joint or the belt therebetween serves as a shock absorber for excessive instantaneous start-up torque, resulting in a reduced load on the electric motor. However, when the electric motor and the rotor are firmly joined together, such an effect will not result. Especially when the shaft of the rotor and the shaft of the electric motor are formed as one shaft, excessive torque is directly transmitted to the electric motor. This imposes a large load on the electric motor and subjects the electric motor to a tough operating condition.

The above problems with start-up torque have long been faced by screw compressors, and various approaches have been proposed thus far. For example, JP-2003-003976-A discloses a method in which a compressor is provided with an extra outlet port that opens only during start-up in addition to a typical outlet port for the purpose of lowering start-up torque.

This method, however, necessitates the attachment of a valve mechanism and its opening/closing means to the body of a conventional compressor, posing problems associated with increase in structural complexity and manufacturing costs.

In view of the above, an object of the invention is thus to lower excessive start-up torque which is attributable to oil and to provide an oil-flooded screw compressor that includes an electric motor with proper capacity for normal operation and is capable of reliable start-up even in a cold environment.

Another object of the invention is to provide a motor drive system that includes a control device designed to give instructions to an inverter according to the start-up status of an electric motor.

To achieve the above objects, an oil-flooded screw compressor according to the invention comprises: a casing; a pair of rotors each having screw-thread-shaped groove and being housed in the casing; an electric motor for rotationally driving the pair of rotors; a control device for controlling the electric motor; an oil feeding mechanism for feeding oil into working chambers formed by being enclosed by the casing and the pair of rotors in which teeth thereof are meshed to each other; and an oil separating mechanism for separating the oil from compressed gas discharged from the working chambers; wherein during the time interval in which the pair of rotors in normal operation is brought to a halt and then the electric motor is started up to bring the pair of rotors back into normal operation, the control device exercises control such that at least part of the oil fed into an internal space of the casing that houses the pair of rotors is discharged outside the internal space.

To achieve the above objects, a motor drive system according to the invention comprises: an electric motor that is connected to an object to be driven; an inverter for controlling the rotational speed of the electric motor; and a control device for giving a first rotational-speed instruction to the inverter based on setup information from a setup device that sets an operating condition for the object to be driven and on detection information from a detector that detects output information from the object to be driven, wherein upon start-up of the electric motor, the control device gives to the inverter a second rotational-speed instruction that designates a rotational speed lower than that designated by the first rotational-speed instruction based on start-up torque estimate information on the object to be driven, and the control device gives the first rotational-speed instruction to the inverter after the electric motor is driven based on the second rotational-speed instruction.

In accordance with the present invention, smooth start-up of oil-flooded screw compressors can be ensured. In addition, because such smooth start-up can be ensured by a structure comprising small, low-output devices, this leads to reduction in the weights and manufacturing costs of oil-flooded screw compressors and also to efficient use of energy because an optimal electric motor for normal operation can be selected flexibly.

DESCRIPTION OF THE PREFERRED EMBODIMENTS

Figure 1:
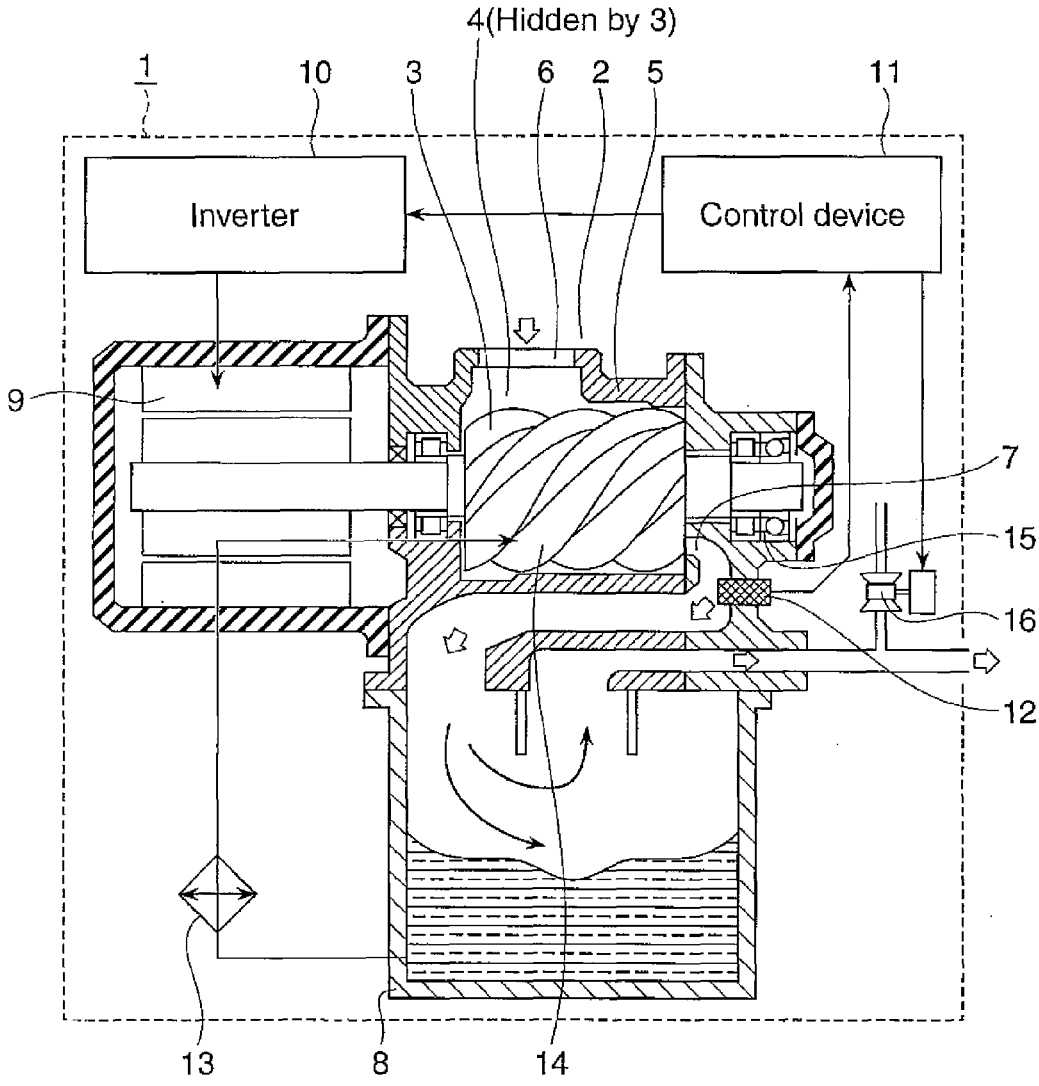
FIG. 1 is a schematic illustrating of the main unit, peripheral parts, and oil feeding system of an oil-flooded screw compressor according to first and second embodiments of the invention.

Preferred embodiments according to the invention will now be described. Oil-flooded screw compressors according to the preferred embodiments of the invention each comprise: a casing; a pair of rotors each having screw-thread-shaped groove, the pair of rotors being housed in the casing; an electric motor for rotationally driving the pair of rotors; a control device for controlling the electric motor; an oil feeding mechanism for feeding oil into working chambers formed by being enclosed by the casing and the pair of rotors in which teeth thereof are meshed to each other; and an oil separating mechanism for separating the oil from compressed gas discharged from the working chambers.

For such an oil-flooded screw compressor to perform smooth start-up reliably, the control device exercises control, during the time interval in which the pair of rotors in normal operation is brought to a halt and then the electric motor is started up to bring the pair of rotors back into normal operation, such that at least part of the oil fed into an internal space of the casing that houses the pair of rotors is discharged from the internal space.

A conventional oil-flooded screw compressor often accelerates quickly after start-up up to a normal-operation rotational speed even when oil remains in the internal space of the casing that houses rotors.

In contrast, an oil-flooded screw compressor according to a first embodiment of the invention rotates its rotors at a rotational speed which is sufficiently lower than a normal-operation rotational speed for a fixed amount of time during start-up and thereafter accelerates the rotors up to the normal-operation rotational speed. Specifically, when the rated operating speed of the oil-flooded screw compressor is for example 3,000 rpm, the rotors are rotated during start-up at a low rotational speed of 300 rpm or below for about three seconds or rotated about five times at that speed.

The start-up of the above compressor can also be such that only when the temperature at the time of start-up is found lower than a given temperature by temperature detection means are the rotors allowed to rotate at the rotational speed which is sufficiently lower than the normal-operation rotational speed for the fixed amount of time and thereafter accelerate up to the normal-operation rotational speed.

Further, when an oil-flooded screw compressor according to a second embodiment of the invention receives a halt instruction during operation, the compressor operates to halt its electric motor and at the same time discharges high-pressure gas that remains inside the pipe that communicates with the discharge side of its rotor casing. Thus, the high pressure on the discharge side decreases gradually to as low as the intake-side pressure. Thereafter, the rotors are controlled so as to rotate at a low rotational speed for only a short amount of time.

Furthermore, an oil-flooded screw compressor according to a third embodiment of the invention includes a pathway that communicates with a lower section of an internal intake-side space of the casing and with an oil reservoir which is located below the lower section of the casing that houses rotors and also includes a check valve in the middle of the pathway, the check valve allowing oil to flow only in the direction from the internal intake-side space of the casing to the oil reservoir.

Figure 2:
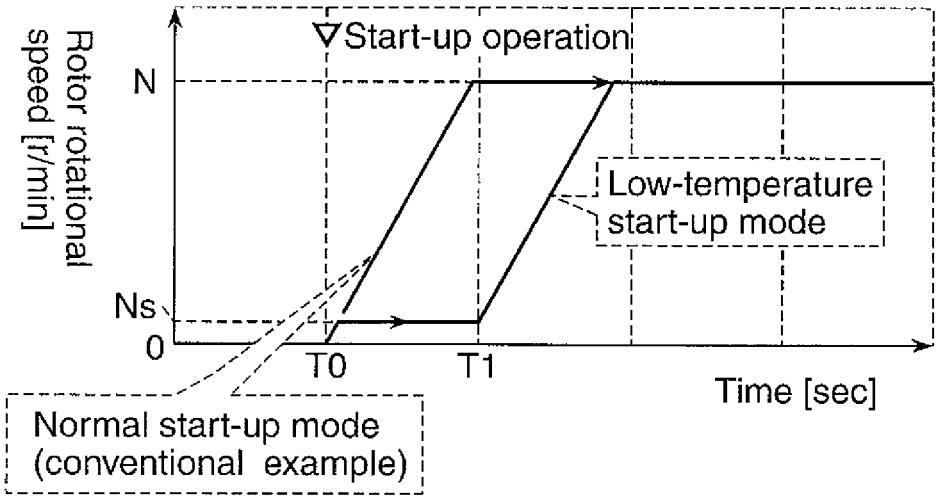
FIG. 2 is a graph showing changes in the rotational speed of rotors before and after start-up.

The preferred embodiments of the invention are discussed in detail below. The first embodiment of the invention is described first with reference to FIGS. 1 and 2. FIG. 1 is a schematic illustrating an oil-flooded screw air compressor (hereinafter also referred to as "air compressor"), and FIG. 2 is a graph showing changes in the rotational speed of its rotors before and after start-up.

The air compressor, designated 1, houses a compressor body 2 in which meshed male and female rotors, 3 and 4, respectively, are provided rotatably. The rotors 3 and 4 have screw-thread-shaped groove on the outer surfaces of their respective rotary shafts.

The casing 5 that houses the rotors 3 and 4 has internal spaces that surround the outer-circumferential areas of the rotors 3 and 4 and the end faces of the rotors 3 and 4 in a shaft-extending direction. The casing 5 is provided with a suction port 6 through which air is drawn in for compression and a delivery port 7 through which compressed air is discharged such that the suction port 6 and the delivery port 7 communicate with some of the internal spaces.

The pathway that communicates with the delivery port 7 extends in the right direction of FIG. 1 once and thereafter makes a downward U-turn to communicate with an oil separator 8 that is located below the compressor body 2 and provided integrally with the casing 5.

The shaft of the male rotor 3 is connected to the rotary shaft of an electric motor 9. The electric power supplied from an inverter 10, a power supply unit, is used by the electric motor 9 to generate a rotational force to rotate the male rotor 3. The inverter 10 controls the frequency and voltage of the electric power supplied to the electric motor 9 based on an instruction from a control device 11, a motor control device for the inverter 10.

A temperature sensor 12, or temperature detection means, is provided downstream of the delivery port 7. The output of the temperature sensor 12 is input to the control device 11. The temperature sensor 12 is a sensor used to monitor the temperature of the compressed air discharged from the compressor body 2 and to judge the presence or absence of abnormalities.

The oil separator 8 separates oil by centrifugation from the compressed air discharged from the compressor body 2 by utilizing the principles of cyclone separators. The separated oil falls to the bottom of the oil separator 8 to accumulate. The accumulated oil is fed via a pipe, that communicates with a lower section of the oil separator 8, through an oil cooler 13 into working chambers 14 of the compressor body 2 again when the working chambers 14 are ready for air compression, and also into bearings 15 that journal the rotors 3 and 4. The pressure inside the oil separator 8 is almost as high as the discharge pressure of the compressor body 2, and the pressures inside the working chambers 14 and the pressure around the bearings 15 are lower than the pressure inside the oil separator 8, albeit slightly higher than the intake pressure of the compressor body 2. Thus, the first embodiment employs a differential-pressure oil injecting mechanism which is capable of injection of oil based on a differential-pressure, without an oil pump provided between the oil separator 8 and the working chambers 14 or the bearings 15. The use of such a differential-pressure oil injecting mechanism allows the oil injected into the working chambers 14 to be discharged again from the delivery port 7 with compressed air and to return to the oil separator 8 again for circulation.

The oil separator 8 is provided with a compressed-air outlet port in its upper center. The compressed-air outlet port communicates with a flow path for compressed air from which the grater part of oil has been separated. The flow path is provided with an air discharge path that branches therefrom, and the air discharge path is provided with a solenoid valve 16, located immediately downstream of the branch point. The solenoid valve 16 opens or closes based on an instruction from the control device 11. The downstream side of the solenoid valve 16 is designed to discharge the compressed air into the atmosphere via a muffler. The solenoid valve 16 is controlled to be in a closed state during operation and in an open state during a halt, as will be discussed later.

When the operator gives a halt command (by, for example, turning a switch off) to the control device 11 of the air compressor 1 in operation, the control device 11 gives an instruction for the inverter 10 to decelerate and halt. In response to the instruction, the inverter 10 immediately lowers the frequency of the power supplied to the electric motor 9 and comes to a halt. The electric motor 9, the male rotor 3 connected directly to the output shaft of the electric motor 9, and the female rotor 4 meshed with the male motor 3 cease to rotate immediately after the power supply is stopped, albeit the halt of the rotation may not be exactly synchronous with the power supply stop due to the law of inertia. The control device 11 also gives an instruction for the solenoid valve 16 to open, which is almost simultaneous with the halt instruction to the electric motor 9. The compressed air that lies in the pathway that extends from the delivery port 7 of the compressor body 2, in the oil separator 8, and in the high-pressure pipes located downstream of the oil separator 8 is discharged into the atmosphere via the opened solenoid valve 16, and the pressures inside those spaces gradually decrease in about 10 to 30 seconds. During this time, the differential pressure between the oil separator 8 and the working chambers 14 still remains, which means that for a short amount of time after the halt of the rotors 3 and 4, oil continues to be injected into the working chambers 14 that ceased to move. Even after the differential pressure disappears, the oil injected into the working chambers 14 during that time stays there. If the halt of the air compressor 1 lasts for a long time, the oil inside the working chambers 14 is cooled gradually to the ambient temperature.

The start-up process of the oil-flooded screw compressor 1 according to the first embodiment is described next.

When the temperature sensor 12 senses the ambient temperature to be less than a predetermined temperature (e.g., less than 10 degrees Celsius) at the time of start-up which is prompted by pressing the starter switch of the compressor 1, the control device 11 employs, based on its own judgment, low-temperature start-up mode which is different from normal start-up mode. As shown in FIG. 2, the normal start-up mode allows the rotors 3 and 4 to accelerate immediately after start-up, or immediately after time T0, and the rotors 3 and 4 accelerate quickly up to a rotational speed N, which is the speed during normal operation. This makes it possible for the oil-flooded screw compressor 1 to quickly supply the compressed air required for the operator. In the low-temperature start-up mode, the rotors 3 and 4 rotate at a low rotational speed Ns for a fixed amount of time (from time T0 to T1) after start-up. It is assumed herein that the rotors 3 and 4 rotate at 300 rpm or thereabout for three seconds after start-up. Thereafter, the rotors 3 and 4 accelerate quickly up to the rotational speed N of normal operation (3,000 to 4,000 rpm).

The reason that the rotors 3 and 4 rotate at the low rotational speed Ns for a fixed amount of time when the temperature is low is to discharge the oil accumulated inside the working chambers 14. The torque required for the oil discharge is correlated with the rotational speed of the rotors 3 and 4, and even if the oil becomes high in viscosity due to the low temperature, a small torque is enough for the oil discharge as long as the rotors 3 and 4 rotate at a low rotational speed. Besides, because the amount of the oil accumulated inside the working chambers 14 is small, the screw rotors 3 and 4 can, by their nature, discharge the grater part of the oil from the delivery port 7 by rotating, for example, five times or for one to two seconds. After the oil is discharged, the torque required for oil discharge is no longer necessary, allowing the rotors 3 and 4 to accelerate quickly without imposing loads on the electric motor 9 and the inverter 10.

Rotating the rotors 3 and 4 several times at a low rotational speed before accelerating them quickly means distributing oil into mechanical elements such as the bearings and shaft seals that require lubricant oil, before increasing loads on such mechanical elements. This leads to better lubrication conditions, which in turn prevents such mechanical elements from becoming worn and extends their mechanical lives.

The low-temperature start-up mode mentioned above is especially effective when the oil-flooded screw compressor 1 is started up after a long period of halt. When the rotors 3 and 4 need to be accelerated quickly even in a low-temperature environment, the electric motor 9 and the inverter 10 can be ones with high capacity. However, the use of such high-capacity devices that are not required during steady operation is inefficient in terms of energy use and manufacturing costs. In contrast, the configuration of the first embodiment allows the oil-flooded screw compressor 1 to start up smoothly even in the low-temperature environment without increase in costs and energy use during steady operation.

When the ambient temperature is high enough, the convention normal start-up mode is employed, thereby supplying compressed air quickly. The first embodiment is also effective in preventing rust inside the oil-flooded screw compressor 1 since oil is accumulated in the working chambers 14 during a halt. Further, the first embodiment does not require to add expensive components and has an easy-to-design structure, compared with conventional air compressors.

By way of example, the motor drive system of the first embodiment is a variable-speed drive model that involves the use of an inverter and is much needed in terms of semiconductor current limits. However, a constant-speed drive model without an inverter also brings about the same effects and results. The same applies to the use of a model in which the output shaft of the electric motor 9 is not directly connected to the input shaft of the male rotor 3 but connected via power transmission means such as shaft joints, gears, and belts. However, the configuration of the first embodiment is not necessarily required when an induction motor is used to driving the rotors 3 and 4 via a belt because an instantaneous start-up torque peak is reduced by that soft belt, and when an induction motor is used which does not involve the use of a semiconductor-used inverter because excessive instantaneous torque can be generated. Furthermore, although the oil-flooded screw compressor 1 of the first embodiment is designed to compress air, the same effects can also be brought about when the oil-flooded screw compressor 1 is intended for use in compressing refrigerant gas, fuel gas, or other gasses.

Although the first embodiment allows the rotors 3 and 4 to rotate at the low rational speed Ns for a fixed amount of time, the low rotational speed Ns is not necessarily a fixed speed. For example, the same effects can also be brought about by gradually increasing the low rotational speed Ns as long as the low rotational speed Ns is sufficiently smaller than the rotational speed N, which is the speed during normal operation.

Figure 3:
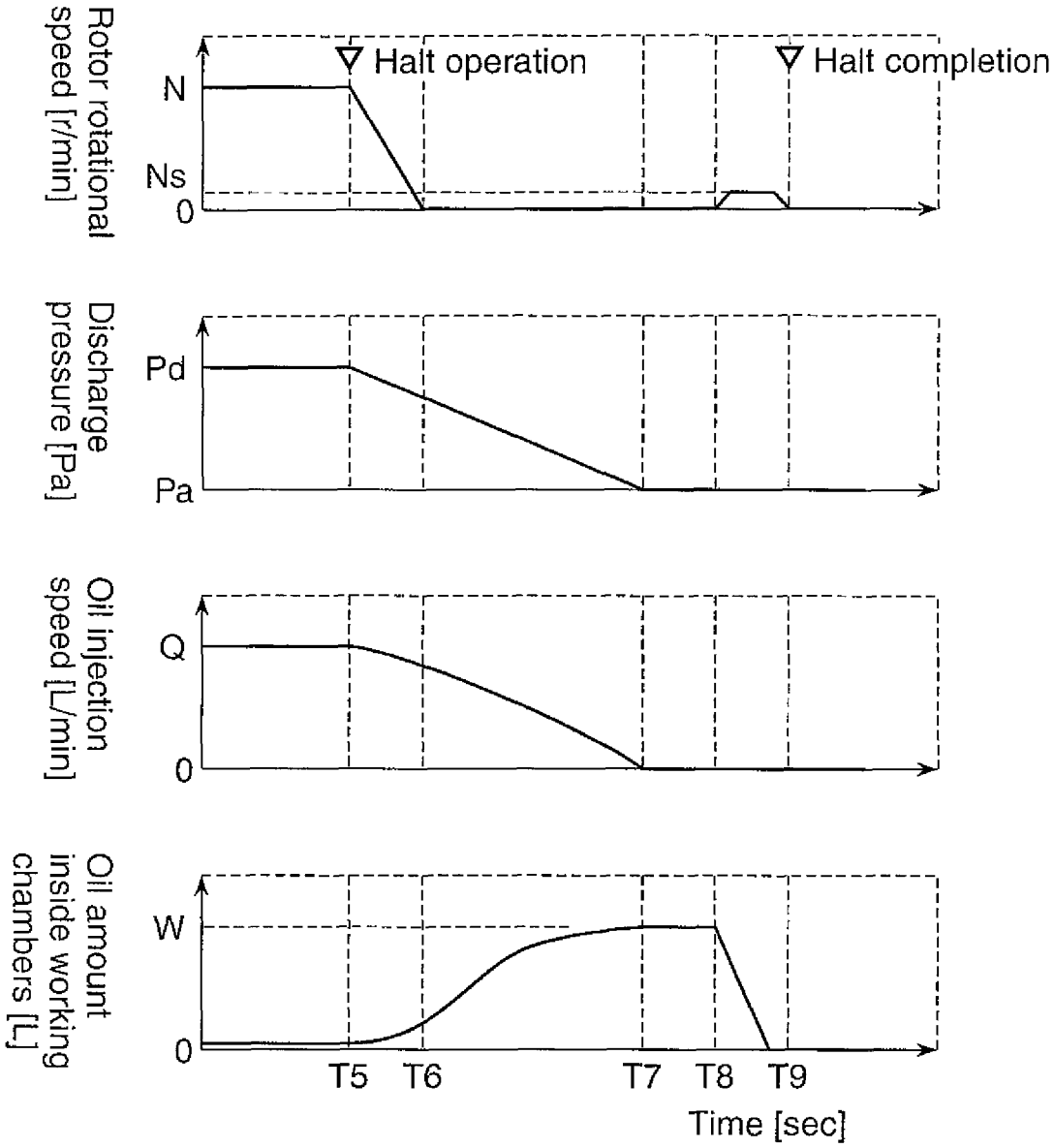
FIG. 3 is graphs showing changes in rotor rotational speed, oil injection amount, and the like during halt operation.

The second embodiment according to the invention will now be described with reference to FIG. 3. FIG. 3 is graphs showing temporal changes in rotor rotational speed, discharge pressure, oil injection amount, and oil amount inside the working chambers 14 when the oil-flooded screw compressor 1 is instructed to halt. Discussion of the same structure, operation, effects, and applicability of the second embodiment as those of the first embodiment is omitted.

The mechanical structure of the oil-flooded screw compressor 1 of the second embodiment is the same as that of the first embodiment shown in FIG. 1. However, the oil-flooded screw compressor 1 of the second embodiment differs in the software installed in the control device 11 and has a different halt process from conventional ones. Further, the oil-flooded screw compressor 1 of the second embodiment does not necessarily require the temperature sensor 12.

The second embodiment is distinctive in halt operation, and how the halt operation works is described with reference to FIG. 3.

A halt operation is done at time T5 of FIG. 3 by, for example, the operator turning off the operation switch of the oil-flooded screw compressor 1 in operation that is supplying compressed air at the rotational speed N and at a discharge pressure Pd. Immediately thereafter, the control device 11 gives an instruction for the inverter 10 to halt, which in turn prompts the inverter 10 to lower the frequency of the power supplied to the electric motor 9. The inverter 10 stops the power supply at time T6 (e.g., in 2 to 5 seconds after time T5). Meanwhile, the electric motor 9 and the rotors 3 and 4 decrease in rotational speed, resulting in a stop at time T6 or thereabout.

While giving the instruction to halt the electric motor 9 at time T5, the control device 11 also gives an instruction for the solenoid valve 16 to open almost at the same time as time T5. By opening the solenoid valve 16, compressed air is discharged from the delivery port 7 of the compressor body 2 through the oil separator 8, the high-pressure pipes located downstream of the oil separator 8, and the solenoid valve 16 into the atmosphere. The pressure inside the pipes gradually decreases from a discharge pressure Pd which is the pressure during operation, to an atmospheric pressure Pa at time T7 which is 10 to 30 seconds later after time T5. Because the differential pressure between the working chambers 14 and the oil separator 8 remains for a while after the halt of the rotors 3 and 4, i.e., from time T6 to T7, oil continues to be injected into the working chambers 14 that ceased to rotate. As shown in FIG. 3, although discharged sequentially into the oil separator 8 by the rotation of the rotors 3 and 4 during operation, the oil starts to accumulate rapidly inside the working chambers 14 at time T6 when the halt of the rotors 3 and 4 stops oil discharge, and continues to accumulate until time T7.

In conventional oil-flooded screw compressors, the next start-up operation has commonly been done with oil accumulated inside their working chambers as above. In contrast, the second embodiment is characterized by the following operation.

At time T8 when the discharge pressure is low enough, the control device 11 instructs the rotors 3 and 4 to rotate at the low rotational speed Ns for only a short amount of time (from time T8 to T9). In response to the instruction, the inverter 10 drives the electric motor 9 at a low frequency, thereby rotating the rotors 3 and 4 at the low rotational speed Ns (e.g., 100 rpm or thereabout). This allows the oil accumulated inside the working chambers 14 to be discharged from the delivery port 7. During this time, the temperature inside the compressor body 2 is not much lower than that during operation, and the oil is low in viscosity. Therefore, only a small torque is necessary for oil discharge, and the rotors 3 and 4 can rotate easily. Further, since the rotors 3 and 4 rotate at the low rotational speed Ns for only a short amount of time with the solenoid vale 16 open, the discharge-side pressure does not increase. Thus, the oil is never fed back from the oil separator 8 to the working chambers 14.

Most of the oil accumulated inside the compressor body 2 is thus discharged by the rotation of the rotor 3 and 4 by time T9 when the low-speed drive operation ends. The halt operation ends in this state at time T9, putting the oil-flooded screw compressor 1 on standby for the next start-up operation. It should be note that time T8, the start time of the low-speed drive operation, and time T9, its end time, are set based on time T5, the start time of the halt operation, with the use of the timer function of the control device 11.

In the next start-up operation to be performed after the halt operation described above, less oil stays around the rotors 3 and 4, and the torque required for the oil discharge is small enough to be neglected even if it is to be performed in a cold environment. Accordingly, a smooth and reliable start-up operation becomes possible without high capacities of an electric motor 9 and an inverter 10.

The low-speed, short-time rotation of the rotors 3 and 4 during the above halt operation is controlled by a setting in the software of the control device 11. The rotation can be controlled by desired rotational time (e.g., 2 to 3 seconds) or by the desired number of rotations in total (e.g., 5 to 10 rotations). In either case, sensors to detect oil amounts or torques are not necessary, and no major changes in design are required except for the software, compared with conventional oil-flooded screw compressors.

The second embodiment allows the objects of the invention to be achieved without making major changes to the designs of conventional models. The second embodiment also allows the rotors 3 and 4 to accelerate immediately after start-up even in a cold environment, thus supplying compressed air in a short amount of time after the oil-flooded screw compressor 1 is switched on.

Figure 4:
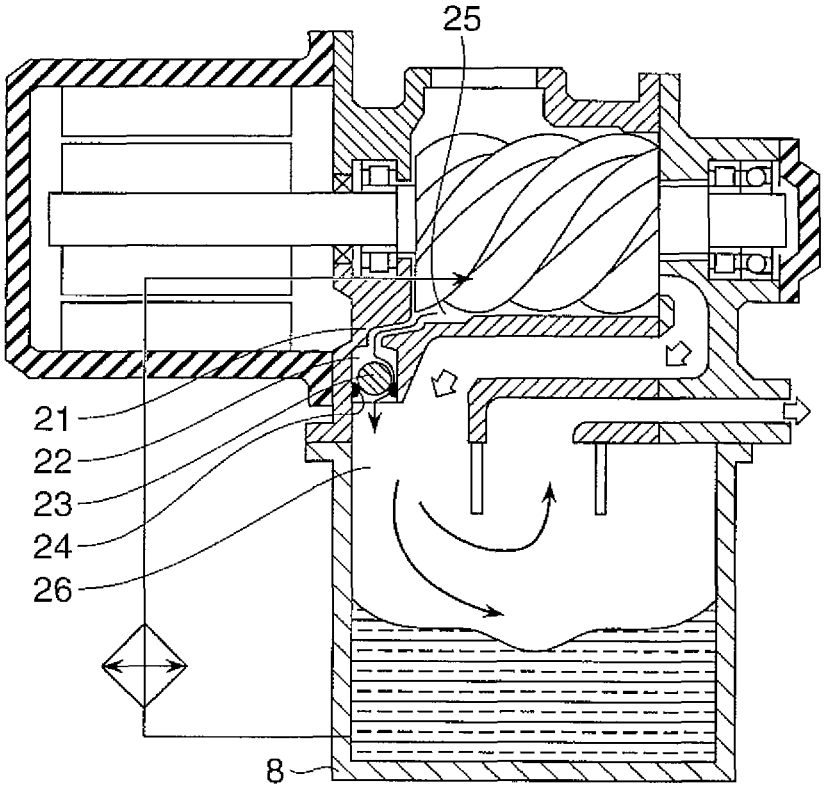
FIG. 4 is a schematic illustrating of the main unit, peripheral parts, and oil feeding system of an oil-flooded screw compressor according to a third embodiment of the invention.

The third embodiment of the invention will now be descried with reference to FIG. 4. FIG. 4 is a schematic illustrating an oil-flooded screw air compressor 1'. Discussion of the same structure, operation, effects, and applicability of the third embodiment as those of the first embodiment is omitted.

The mechanical structure of the oil-flooded screw compressor 1' of the third embodiment is basically the same as that of the first embodiment shown in FIG. 1 and does not require any special control devices or control software. Further, the oil-flooded screw compressor 1' of the third embodiment does not necessarily require the temperature sensor 12.

As shown in FIG. 4, a major difference from the first and second embodiment lies in a communication path 21 that is provided so as to communicate with an intake-chamber lower section 25, or the bottom part on the intake side, of the internal space of the casing 5 that houses the male and female rotors 3 and 4 and with an oil-separator upper section 26. Arranged in the middle of the communication path 21 is a valve chest 22 that houses a ball-shaped valving element 23 that is smaller in cross-sectional area than the valve chest 22 and allowed to move freely inside the valve chest 22. In addition, multiple projections 24 are arranged on the lower sections of the inner sidewall of the valve chest 22 so as to face the inner side of the valve chest 22, thereby preventing the valving element 23 from falling down from the valve chest 22. On the other hand, the top section of the valve chest 22 that communicates with the communication path 21 is allowed to be shut with the valving element 23.

While the oil-flooded screw compressor 1' is in operation, the pressure in the oil-separator upper section 26 is higher than that in the intake-chamber lower section 25 due to the action of compression. During that time, the valving element 23 is thus elevated up to the top section of the valve chest 22 to shut the communication path 21. This means that the compressed air discharged from the delivery port 7 never returns to the intake-chamber lower section 25.

When the oil-flooded screw compressor 1' is brought to a halt, the pressures inside the oil-flooded screw compressor 1' become uniform, and gravity causes the valving element 23 to fall and rest on the projections 24. The external diameter of the valving element 23 is smaller than the internal diameter of the valve chest 22, and there are spaces between and around the projections 24. Thus, the communication path 21 is in communication with the intake-chamber lower section 25 and the oil-separator upper section 26 during the halt of the oil-flooded screw compressor 1' and oil which would otherwise accumulate inside the intake chamber falls by gravity through the communication path 21 into the oil separator 8. Accordingly, when the oil-flooded screw compressor 1' is started up again, less oil remains around the rotors 3 and 4, hence causing no problems with the start-up.

The third embodiment allows the objects of the invention to be achieved without adding any special electrical functions or special control functions. Thus, the third embodiment is applicable to constant-speed drive models without speed changing functions such as inverters and the like.

As stated above, the valving element 23 of the third embodiment serves as a check valve such that it has ball-shape to shut the circular hole and utilizes gravity to open the circular hole. However, other check valves can also be used as long as they serve similar functions. Examples of such check valves include plate-shaped check valves which open and close by hinges and check valves which open and close by the action of springs.

What is claimed is:

1. An oil-flooded screw compressor, comprising:

a casing;

a pair of rotors each having a screw-thread-shaped groove and being housed in the casing;

an electric motor for rotationally driving the pair of rotors;

a control device for controlling the electric motor;

an oil feeding mechanism for feeding oil into working chambers formed by being enclosed by the casing and the pair of rotors in which teeth thereof are meshed to each other; and an oil separating mechanism for separating the oil from compressed gas discharged from the working chambers;

wherein during the time interval in which the pair of rotors in normal operation is brought to a halt and then the electric motor is started up to bring the pair of rotors back into normal operation, the control device exercises control such that at least part of the oil fed into an internal space of the casing that houses the pair of rotors is discharged outside the internal space, and wherein upon receipt of a halt instruction, the control device stops the electric motor to bring the pair of rotors to a halt and exercises control so as to discharge, into the atmosphere, high-pressure compressed gas that remains inside a discharge pipe that communicates with a delivery port provided on the casing and for the working chambers to discharge the high-pressure compressed gas, and the control device then exercises control such that the pair of rotors rotate at a low speed for a fixed amount of time after the pressure near the delivery port decreases to the pressure near a suction port provided for the working chambers.

2. The oil-flooded screw compressor defined in claim 1, wherein during the time interval in which the electric motor is started up after the halt of the pair of rotors and then the rotational speed of the pair of rotors reaches a normal-operation rotational speed, the control device exercises control such that the pair of rotors rotate at a rotational speed lower than the normal-operation rotational speed and such that the rotational speed of the pair of rotors then accelerates up to the normal-operation rotational speed.

3. The oil-flooded screw compressor defined in claim 2, further comprising temperature detection means, wherein upon start-up at a temperature less than a predetermined temperature, the control device exercises control such that the pair of rotors rotate at the rotational speed lower than the normal-operation rotational speed and such that the rotational speed of the pair of rotors then accelerates up to the normal-operation rotational speed.

4. The oil-flooded screw compressor defined in claim 1, wherein the oil feeding mechanism feeds the oil into the working chambers by utilizing the differential pressure between the pressure of gas from which the oil is separated by the oil separating mechanism and the pressure of gas inside the working chambers before gas discharge, and the oil feeding mechanism comprises an oil reservoir for impounding the oil separated by the oil separating mechanism and a pathway that connects a space that receives the gas from which the oil is separated by the oil separating mechanism to one of the working chambers that is in a pre-discharge pressure state.

5. The oil-flooded screw compressor defined in claim 1, wherein the electric motor is driven by electric current that passes through the control device, and the output shaft of the electric motor is connected to the rotary shaft of one of the pair of rotors.

6. The oil-flooded screw compressor defined in claim 1, further comprising:

an oil reservoir for impounding the oil separated by the oil separating mechanism, the oil reservoir being provided below the casing that houses the pair of rotors;

a pathway that communicates with the oil reservoir and with an internal space of the casing; and a check valve for allowing the oil to flow only in the direction from the internal space of the casing that houses the pair of rotors to the oil reservoir, the check valve being provided in the middle of the pathway.

* * * * *